US008701924B2

(12) United States Patent
Dalbec

(10) Patent No.: US 8,701,924 B2
(45) Date of Patent: Apr. 22, 2014

(54) PORTABLE MAGNETIC STORAGE DEVICE AND A METHOD OF STORING MATERIAL

(76) Inventor: David Barrett Dalbec, Alexandria, VA (US)

( * ) Notice: Subject to any disclaimer, the term of this patent is extended or adjusted under 35 U.S.C. 154(b) by 0 days.

(21) Appl. No.: 13/573,161

(22) Filed: Aug. 28, 2012

(65) Prior Publication Data

US 2014/0061199 A1 Mar. 6, 2014

(51) Int. Cl.
*B65D 25/24* (2006.01)
*B65D 25/22* (2006.01)

(52) U.S. Cl.
USPC ..... 220/483; 220/480

(58) Field of Classification Search
USPC ..... 220/483, 476, 480, 230, 751; 215/341; 206/350, 818; 211/DIG. 1; 248/683, 248/206.5, 309.4; 335/303, 292, 294
See application file for complete search history.

(56) References Cited

U.S. PATENT DOCUMENTS

| | | | | |
|---|---|---|---|---|
| 5,027,966 | A * | 7/1991 | Yadock | 220/230 |
| 5,368,203 | A * | 11/1994 | Friedrich et al. | 222/179.5 |
| 5,954,220 | A * | 9/1999 | Herbert | 220/276 |
| 6,786,349 | B2 * | 9/2004 | Najd | 220/484 |
| 8,381,949 | B2 * | 2/2013 | Sunatori | 222/142.3 |
| 2004/0262315 | A1 * | 12/2004 | Yoon | 220/480 |
| 2005/0167457 | A1 * | 8/2005 | Barnett | 224/148.7 |
| 2006/0213862 | A1 * | 9/2006 | Smith | 215/228 |
| 2007/0131695 | A1 * | 6/2007 | Hsing-Hsien | 220/483 |
| 2007/0170187 | A1 * | 7/2007 | Tharp et al. | 220/303 |
| 2008/0210689 | A1 * | 9/2008 | Rodewald | 220/230 |
| 2008/0237177 | A1 * | 10/2008 | Robinson | 215/227 |
| 2012/0043348 | A1 * | 2/2012 | Sunatori | 222/142.3 |

* cited by examiner

*Primary Examiner* — Anthony Stashick
*Assistant Examiner* — Robert Stodola

(57) ABSTRACT

A method of storing material includes placing material in a storage container and removably positioning a magnetic device in a cap. The magnetic device includes a gasket including a magnet. Moreover, the method includes removably fastening the cap to the storage container to form a storage device and magnetically attaching the cap to a metal surface.

9 Claims, 4 Drawing Sheets

PORTABLE MAGNETIC STORAGE DEVICE AND A METHOD OF STORING MATERIAL

BACKGROUND OF THE INVENTION

This invention relates generally to a device for conveniently storing material, and more particularly, to a portable magnetic storage device and a method of storing material in the portable magnetic storage device.

Individuals generally buy an item and after using part of the item desire to store the remaining part. For example, after purchasing a spice and using part of the spice to prepare a meal, cooks generally desire to store the remaining spice for future use. Likewise, after purchasing and using nails and screws in a construction project, laborers generally desire to store the remaining nails and screws for future use.

Different types of items may be stored in different types of storage systems. For example, different spices used for cooking may be stored individually in a spice rack type storage system while equipment used for construction, such as screws and nails, may be stored in a storage tray type storage system. Moreover, work tables may be used for storing tools such as hammers, wrenches, and screwdrivers. Magnetic storage systems made of panels with magnetic characteristics are known to be used for storing metal objects. In such magnetic storage systems the metal objects attach to the panels by virtue of panels' magnetic properties. For example, a metal wrench or hammer may simply adhere to a panel by virtue of the panel's magnetic characteristics. Such magnetic panels may be hung on walls such that metal objects attached to the panel may be easily and conveniently hung against the wall.

However, most known storage systems are heavy and cumbersome to move. Consequently, known storage systems typically are not portable and thus cannot be easily or conveniently moved. In storage systems that include several different containers, the individual containers may be individually moved. For example, the storage tray type system discussed above generally includes several different trays that each contain different sized screws or nails. Each different tray may be removed from the tray rack and moved to another location. However, such trays typically have an open top and it is known that the contents may be inconveniently spilled and as a consequence lost during a move. Moreover, such spills may result in additional costs incurred for purchasing replacement contents, as well as from the time it takes a laborer to purchase the replacement contents.

BRIEF DESCRIPTION OF THE INVENTION

In one aspect, a method of storing material is provided. The method includes placing material in a storage container and removably positioning a magnetic device in a cap. The magnetic device includes a gasket including a magnet. Moreover, the method includes removably fastening the cap to the storage container to form a storage device and magnetically attaching the cap to a metal surface.

In another aspect, a portable magnetic storage device is provided. The magnetic storage device includes a cap having a top and an opening positioned in the top, and a gasket removably positioned in the cap to fit snugly in the opening. The gasket includes a magnet. The magnetic storage device also includes a container. The cap is removably fastened to the container to form the portable magnetic storage device.

In yet another aspect, a portable magnetic storage device includes a cap having at least one surface, a magnet attached to the cap, and a container. The cap is removably fastened to the container to form the portable magnetic storage device.

DETAILED DESCRIPTION OF THE INVENTION

Figure 1:
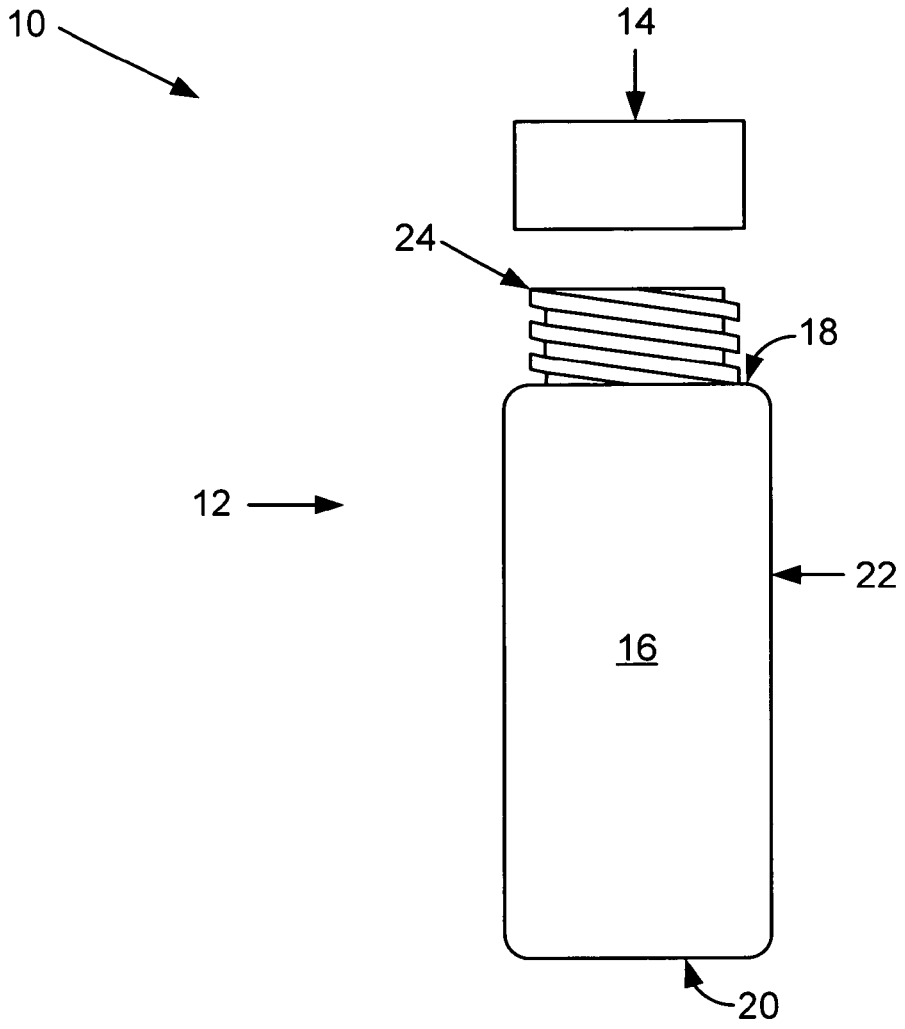
FIG. 1 is a front view of an exemplary storage device.

FIG. 1 is a front view of an exemplary storage device 10. More specifically, the storage device 10 includes a container 12 and a cap 14. The container 12 includes a body 16 having a top 18, a bottom 20, and an exterior surface 22. Moreover, the container 12 includes a neck 24 extending perpendicularly away from the body 16. The cap 14, body 16 and neck 24 have circular cross-sections.

The neck 24 is symmetrically positioned about a center of the top 18. Thus, the neck 24 is concentrically positioned with respect to the body 16. Alternatively, the neck 24 may not be symmetrically positioned about the center of the top 18. In such alternative positions the neck 24 is eccentrically positioned with respect to the body 16. The cap 14 and body 16 may alternatively have any cross-section that facilitates convenient storage of materials as described herein. Such cross-sections include, but are not limited to, an oval, a rectangle, and a square. Moreover, the cross-section of the body 16 may vary. For example, the radius of the body 16 may vary over the length thereof.

The container 12 and cap 14 are both plastic. Alternatively, the container 12 may be any material including, but not limited to, glass, steel, and aluminum. The cap 14 may alternatively be any material including, but not limited to, steel and aluminum. The cap 14 is generally not glass. The storage device 10 is used to store any kind of material. Material as used herein refers to any liquid or object(s) that may be placed in the storage device 10 as contents.

Figure 2:
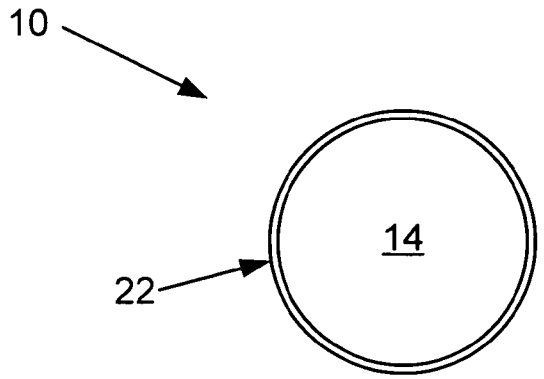
FIG. 2 is a plan view of the storage device shown in FIG. 1.

FIG. 2 is a plan view of an assembled storage device 10, shown in FIG. 1, illustrating the circular shape of the container 12 and cap 14. As discussed above, the container 12 and cap 14 may have any shape including oval, rectangle, and square.

Figure 3:
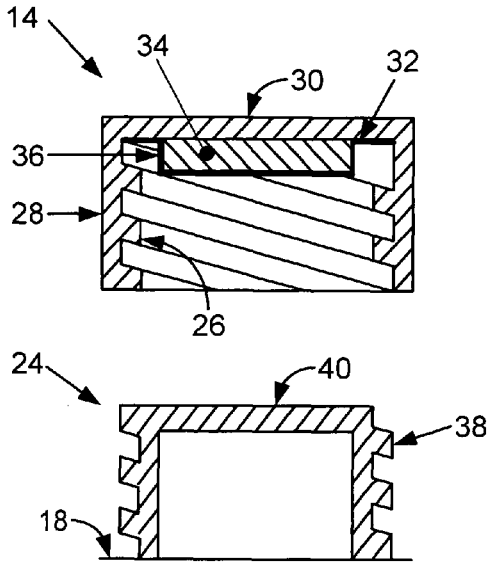
FIG. 3 is an enlarged cross-sectional view of an exemplary cap of the storage device and an exemplary container of the storage device.

FIG. 3 is an enlarged cross-sectional view of the cap 14 and the neck 24. The cap 14 includes an inner threaded surface 26, an outer surface 28, a top outer surface 30, and a top inner surface 32. A magnet 34 is positioned flush against, and is fixed to, the top inner surface 32. The magnet 34 may be fixed to the top inner surface 32 with any type of adhesive or may be mechanically fixed thereto. Adhesives that may be used for fastening the magnet 34 to the surface 32 include, but are not limited to, double sided tape, construction adhesive, glue, rubber cement, and synthetic rubber.

An inert material is applied to the magnet 34 and to the top inner surface 32 to form a seal 36 on the magnet 34 and on the surface 32. The seal 36 creates a barrier between the magnet 34 and the contents of the container 12 such that the magnet 34 does not contaminate the contents and such that the magnet is not damaged by the contents. The seal 36 is made from inert material such as, but not limited to, plastic and rubber.

The neck 24 includes an outer threaded surface 38. After placing material in the container 12, the cap 14 is positioned on a top 40 of the neck 24 and rotated such that the threads of the cap 14 engage the threads of the outer threaded surface 38 until the cap 14 is securely fastened to the container 12. By virtue of securely fastening, or connecting, the cap 14 to the container 12, the storage device 10 is formed. The secure connection between the container 12 and the cap 14 is airtight and watertight. Thus, liquid contents of the storage device 10 do not leak out of, or evaporate over time from, the storage device 10. Delicate, perishable, or fragile items including, but not limited to, food, neck ties or panty hose, jewelry, fire starting implements, identification papers, photographs, important documents, currency, portable media storage devices, electronics, and toiletries and medication placed within the storage device 10 will be protected from the elements along with being prevented from being crushed or bent. The storage device 10 will float when it contains lighter contents. Moreover, the secure connection between the container 12 and the cap 14 ensures that contents, such as drywall screws, will not accidentally be removed from the device 10.

The threads of the inner threaded surface 26 and of the outer threaded surface 38 may be any type of continuous or discontinuous thread that facilitates creating a secure connection between the container 12 and the cap 14. Although the container 12 and the cap 14 are securely fastened together by way of a threaded connection, the container 12 and the cap 14 may be fastened together in any manner that creates a secure, watertight connection therebetween. For example, the container 12 and cap 14 may be securely fastened together with clips.

Figure 4:
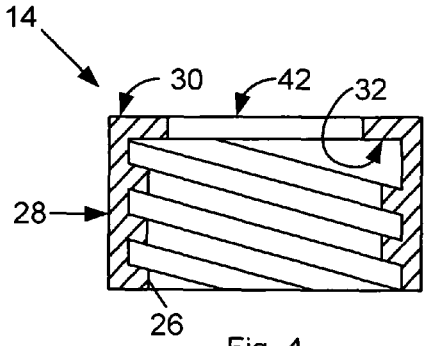
FIG. 4 is an enlarged cross-sectional view of an alternative exemplary cap of the storage device.

The information shown in FIG. 4 is similar to the information shown in FIG. 3 as described in more detail below. As such, features illustrated in FIG. 4 that are identical to features illustrated in FIG. 3 are identified using the same reference numerals used in FIG. 3.

FIG. 4 is an enlarged cross-sectional view of an alternative exemplary cap 14, similar to the exemplary cap 14 shown in FIG. 3. However, the top outer surface 30 includes a circular opening 42.

Figure 5:
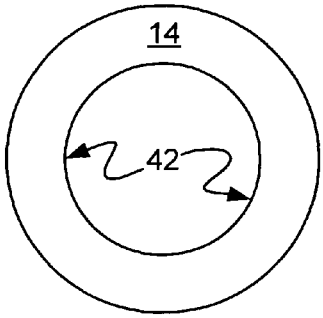
FIG. 5 is a plan view of the alternative exemplary cap shown in FIG. 4.

FIG. 5 is a plan view of the alternative exemplary cap 14 shown in FIG. 4, including the circular opening 42.

Figure 6:
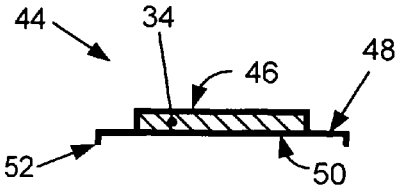
FIG. 6 is an enlarged cross-sectional view of an exemplary gasket.

FIG. 6 is an enlarged cross-sectional view of an exemplary gasket 44. More specifically, the gasket 44 includes a circular housing 46 which has substantially the same diameter as the circular opening 42, and a flange 48 that extends radially away from a base 50 of the housing 46. The housing 46 is positioned on a top side of the base 50 and extends away from the top side. A terminus of the flange 48 has a lip 52 extending perpendicularly from the flange 48 in a direction away from a bottom side of the base 50. The magnet 34 is sealed within the housing 46 such that the magnet 34 does not contact the contents of the container 12. The gasket 44 is made from rubber. However, the gasket 44 may alternatively be made from any flexible inert material capable of sealing the magnet in the housing 46 such that the magnet 34 does not contaminate the contents and so that the contents do not damage the magnet 34.

Figure 7:
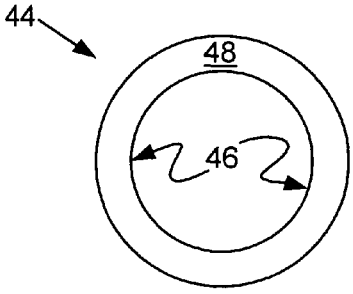
FIG. 7 is a plan view of the exemplary gasket shown in FIG. 6.

FIG. 7 is a plan view of the exemplary gasket 44 shown in FIG. 6 illustrating the circular shape of the gasket 44, including the housing 46 and flange 48.

Figure 8:
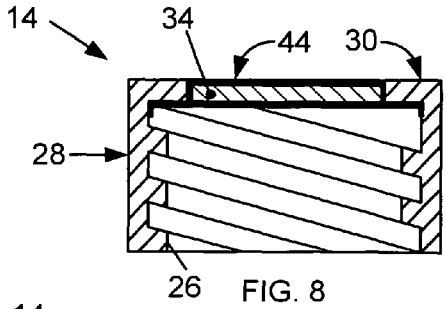
FIG. 8 is the enlarged cross-sectional view of the alternative exemplary cap as shown in FIG. 4, further including the exemplary gasket shown in FIGS. 6 and 7.

FIG. 8 is an enlarged cross-sectional view of the alternative exemplary cap 14 as shown in FIG. 4, further including the gasket 44 shown in FIGS. 6 and 7. More specifically, the gasket 44 is positioned in the cap 14 such that the housing 46 fits snugly in the opening 42 while the flange 48 and lip 52 are positioned against the top inner surface 32 and the inner threaded surface 26, respectively. By positioning the flange 48 and lip 52 against the surface 32 and surface 26, respectively, the flange 48 and lip 52 act to support the housing 46 positioned within the opening 42. In such a position, the flange 48 and lip 52 also facilitate preventing inadvertent removal of the housing from the opening 42. Because the gasket 44 is rubber, or an otherwise flexible material, the flange 48 and lip 52 are flexible and may thus be manipulated to facilitate removing the housing 46 from the opening 42 without damaging either the gasket 44 or the cap 14. After removing the housing 46 from the opening 42, the gasket 44 may be completely removed from the cap 14. Thus, it should be understood that the gasket 44 is removably positioned in the cap 14. The alternative exemplary cap 14 is securely fastened to the container 12 in the same manner as the exemplary cap 14.

Because the gasket 44 is flexible, it can be easily removed from, and positioned in, the cap 14. As the magnetic strength characteristics increase, the weight of a load that may be magnetically attracted to and supported by a magnet 34 also increases. Different gaskets 44 may include magnets 34 of different sizes each having different magnetic strength characteristics. Consequently, different gaskets 44 may be positioned in the cap 14 according to the weight of contents in the storage device 10. For example, when heavier contents such as drywall screws are to be placed in the container 12, a gasket 44 including a magnet 34 with stronger magnetic characteristics should be used. In contrast, when light weight contents such as a spice is to be placed in the container 12 a magnet 34 having weaker magnetic characteristics may be used. Thus, it should be understood that different gaskets 44, and thus magnets 34 having different magnetic strength characteristics, may be readily interchanged in the cap 14 according to the contents of the container 14.

Figure 9:
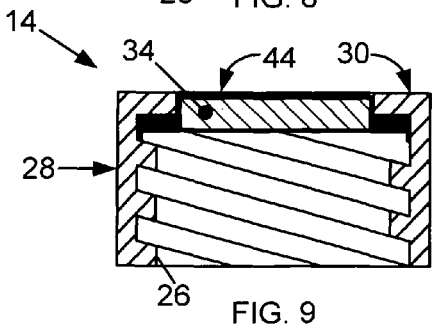
FIG. 9 is the enlarged cross-sectional view of the alternative exemplary cap and gasket as shown in FIG. 8, further including a different sized magnet in the gasket.

FIG. 9 is an enlarged cross-sectional view of the alternative exemplary cap 14 and gasket 44 as shown in FIG. 8, including a different gasket 44 and a different sized magnet 34 relative to the magnet 34 shown in FIG. 8. More specifically, the magnet 34 is larger than the magnet 34 included in the gasket 44 shown in FIG. 8. Such a larger magnet 34 should have stronger magnetic characteristics and thus be capable of supporting a heavier load.

Figure 10:
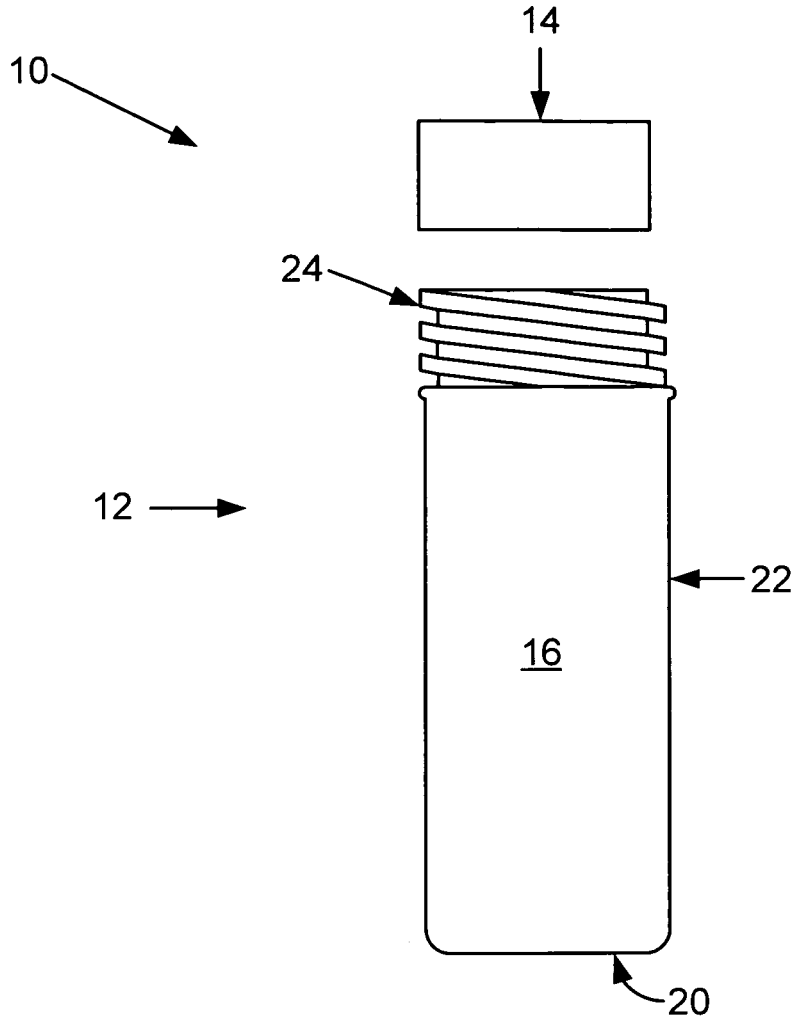
FIG. 10 is a front view of an alternative exemplary storage device.

The information shown in FIG. 10 is similar to the information shown in FIG. 1 as described in more detail below. As such, features illustrated in FIG. 10 that are identical to features illustrated in FIG. 1 are identified using the same reference numerals used in FIG. 1.

FIG. 10 is a front view of an alternative exemplary storage device 10 similar to the exemplary storage device 10 shown in FIG. 1. However, the neck 24 has a diameter substantially the same as a diameter of a top of the container 12.

The storage device 10 may be magnetically attached to any metal surface. The storage device 10 may be full of contents or be partially full of contents when attached to a surface. Moreover, the storage device 10 may be empty when attached to a surface.

The storage device 10 may be used to store any kind of material and may be arranged in any manner while magnetically attached to a surface. The surface may be any surface that is capable of being attracted to a magnet including, but not limited to, a steel stud, the metal surface of a work bench table, a shelf or storage cabinet, a construction storage box or chest, the metal surface of a repair or service vehicle, the side of a refrigerator, a stove, a microwave, an office cubicle, a display rack, an oven, a car, a bike, a boat or ship, the metal surface of a train, a trailer, airplanes, military vehicles, emergency and rescue vehicles, and a countertop.

Figure 11:
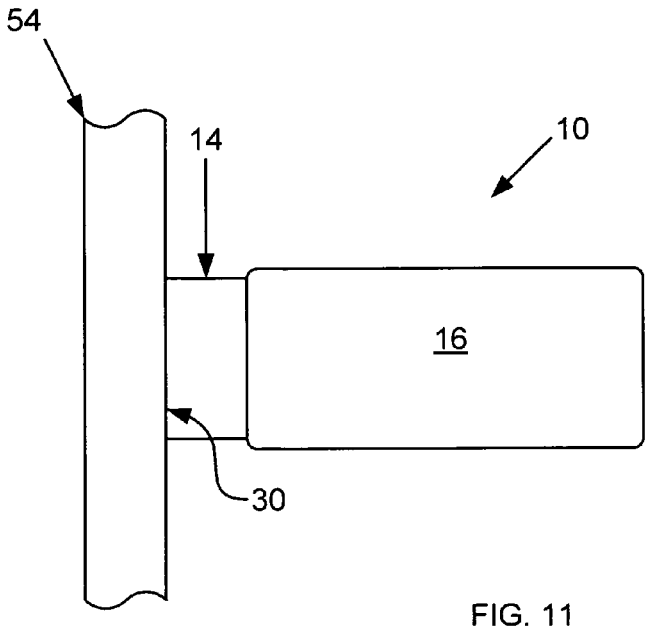
FIG. 11 is a side view of the exemplary storage device magnetically attached to a steel stud.

FIG. 11 is a side view of the storage device 10 magnetically attached to a steel stud 54. More specifically, the top surface 30 of the cap 14 is positioned flush against a surface of the steel stud 54 such that the container 12 extends perpendicularly away from the steel stud 52.

Figure 12:
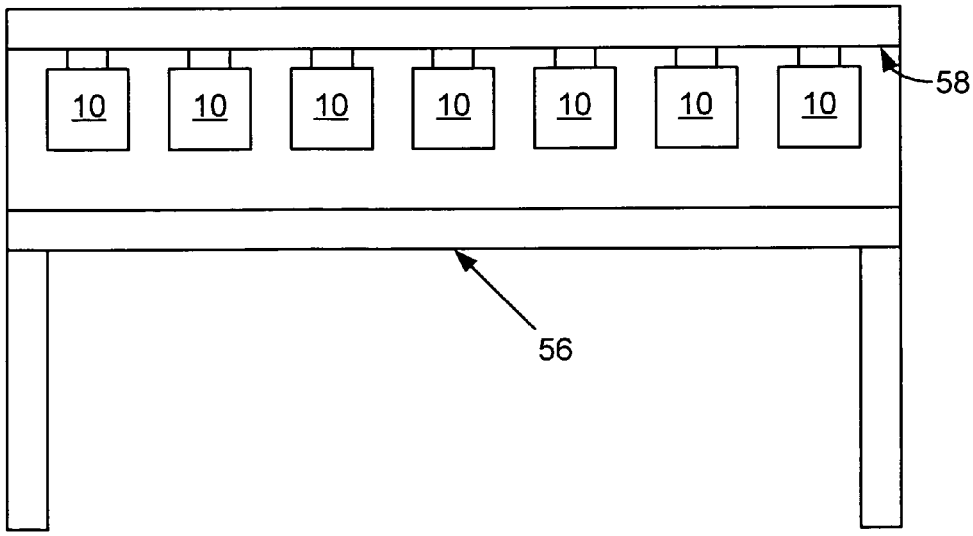
FIG. 12 is an elevation view of an exemplary work table including a plurality of exemplary storage devices.

FIG. 12 is a front view of a work table 56 including a plurality of storage devices 10 magnetically attached thereto. More specifically, the top surface 30 of the caps 14 are positioned flush against a metal surface 58 of the work table 56 such that the storage devices 10 hang from the metal surface.

The cap 14 may be used to magnetically collect material to be stored in the storage device 10. More specifically, the cap 14 may be held and positioned proximate at least one metal object, for example, a dry wall screw, to magnetically attach the screw to a surface of the cap 14. After attaching the screw to the cap 14, the screw may be manually removed from the cap 14 and placed in the container 12, or the cap 14 may be mechanically fastened to the container 12 while the screw is magnetically attached thereto. Any material capable of being attracted to a magnet may be collected with the cap 14 and stored in the storage device 10.

In each embodiment, the above described storage device and methods of using the storage device facilitate storing material in portable devices, which devices can be easily and conveniently moved and magnetically secured to a surface without losing any of the material. More specifically, material is placed in a container, a magnetic device is removably positioned in a cap, and the cap is removably fastened to a container to form the storage device. The magnetic device is a gasket that includes a magnet. The magnet enables attaching the storage device, and thus the contents of the storage device, to any metal surface. As a result, any material may be quickly and securely placed in the storage device, and remain safely stored therein intact, while the security device is magnetically attached to a metal surface in any convenient manner or orientation. Accordingly, the time and effort required to conveniently store materials safely, as well as the costs of storing materials, is facilitated to be reduced.

While the invention has been described in terms of various specific embodiments, those skilled in the art will recognize that the invention can be practiced with modification within the spirit and scope of the claims.

What is claimed is:

1. A portable magnetic storage device comprising:

a cap having a top and an opening positioned in the top;

a gasket removably positioned in the cap to fit snugly in the opening, said gasket including a magnet encapsulated in a circular housing and a flange extending radially from the housing, the flange comprising a terminus, and a lip extending perpendicularly from the terminus; and a container, said cap being removably fastened to said container to form said portable magnetic storage device.

2. A portable magnetic storage device in accordance with claim 1 further comprising an object or liquid placed in said magnetic storage device.

3. A portable magnetic storage device in accordance with claim 1, said gasket being made of a flexible inert material.

4. A portable magnetic storage device in accordance with claim 3, the flexible inert material being one of rubber and plastic.

5. A portable magnetic storage device in accordance with claim 1, wherein said cap includes a top inner surface and an inner threaded surface, the flange includes a first surface positioned against the top inner surface, and the lip is positioned against the inner threaded surface.

6. A portable magnetic storage device comprising:

a cap having a least one surface;

a gasket removably positioned in the cap, said gasket including a magnet encapsulated in a circular housing and a flange extending radially from the housing, the flange comprising a terminus, and a lip extending perpendicularly from the terminus; and a container, said cap being removably fastened to said container to form said portable magnetic storage device.

7. A portable magnetic storage device in accordance with claim 6, said gasket being readily interchangeable in said cap according to the contents of said container.

8. A portable magnetic storage device in accordance with claim 6, said cap further comprising an opening in one of the at least one surfaces.

9. A portable magnetic storage device in accordance with claim 6, wherein said cap includes a top inner surface and an inner threaded surface, the flange includes a first surface positioned against the top inner surface, and the lip is positioned against the inner threaded surface.

* * * * *